US005386474A

United States Patent [19]

Grodinsky et al.

[11] Patent Number: 5,386,474

[45] Date of Patent: Jan. 31, 1995

[54] AMPLIFIER-SPEAKER INTERFACE CORRECTION CIRCUIT

[76] Inventors: Robert M. Grodinsky, 4448 W. Howard, Skokie, Ill. 60076; David G. Cornwell, 3735 N. Ridgeway, Chicago, Ill. 60618

[21] Appl. No.: 108,092

[22] Filed: Aug. 17, 1993

[51] Int. Cl.[6] ..... H04R 25/00

[52] U.S. Cl. ..... 381/28; 381/24; 381/93; 381/94

[58] Field of Search ..... 381/28, 93, 94, 95, 381/99, 107, 1, 24; 330/124 D, 124 R

[56] References Cited

U.S. PATENT DOCUMENTS 3,478,167 11/1969 Sorkin ..... 330/124 R
4,164,625 8/1979 Igeta ..... 381/28
4,638,505 1/1987 Polk et al. ..... 381/24
4,759,066 7/1988 Polk et al. ..... 381/24

OTHER PUBLICATIONS

Byerly et al., Linear Applications, Dec. 1972, p. AN6-9-5.

*Primary Examiner*—Curtis Kuntz
*Assistant Examiner*—Sinh Tran
*Attorney, Agent, or Firm*—Nicholas A. Camasto

[57] ABSTRACT

A pair of amplifiers are coupled to respective loudspeakers. The output terminals of the amplifiers are coupled to each other through a filter network for reducing the effects of time delayed acoustic feedback from the ambient surroundings and from the other displaced loudspeaker on the amplifiers.

9 Claims, 3 Drawing Sheets

AMPLIFIER-SPEAKER INTERFACE CORRECTION CIRCUIT

BACKGROUND OF THE INVENTION AND PRIOR ART

This invention relates in general to audio systems and in particular to a novel arrangement for reducing distortion in multiple amplifier, multiple loudspeaker installations. The progress in digital recording has created an opportunity for advancing the accuracy of sound reproduction. The latest advances in digital to analog signal conversion yield low noise signal sources with dynamic ranges of up to 90 dB. When signals from such sources are reproduced through loudspeakers of improved resolution and dynamic accuracy such as those described in U.S. Pat. Nos. 4,597,100 and 5,070,530 and in co-pending U.S. application Ser. No. 995,833, the resulting high quality audio can be used to make more accurate listening evaluations. In particular, new insights into the reproduction of ambient information and of the accuracy of stereo imaging become possible. Using these improved playback resources in a variety of different sized rooms and spaces has uncovered previously overlooked problems in sound reproduction, especially where more than one loudspeaker is used as a sound source.

A first problem occurs in sound systems having multiple loudspeakers that are spaced some distance apart and results from a combination of sound transmission directly between the loudspeakers and the reflective interactions of the total sound field with the boundaries of the room. A pair of loudspeakers are the norm for stereo reproduction and multiple loudspeakers are also common in sound reinforcement (public address type) applications. These direct transmission and boundary reflection processes interact with the amplification system to undesirably reinforce room colorations, echoes and acoustic feedback.

A second problem occurs in most listening areas because the acoustic surrounding of each loudspeaker system, and thus the acoustic loading on each loudspeaker, is different. As a result of this loading difference, the acoustic output of each of the loudspeakers is not identical. Loading differences, even when small, have been found to degrade reproduction of stereo "phantom" center images and cause the loudspeaker placement in the listening area to be critical.

This invention discloses a circuit that is connected between the four output terminals of a pair of power amplifiers to reduce the effects of loudspeaker-to-loudspeaker coupling and loudspeaker-to-room interaction. In stereo sound reproduction systems this invention results in improvements in harmonic accuracy, stereo imaging and bass reproduction. In sound reinforcement systems, the invention reduces acoustic feedback and greatly improves intelligibility.

OBJECTS OF THE INVENTION

A principal object of the invention is to reduce the interaction between an acoustical environment and a sound reproduction system.

Another object of the invention is to provide an improved multiple audio power amplifier, multiple loudspeaker, sound reproduction system.

A further object of the invention is to improve the accuracy of reproduction of stereo sound reproduction systems.

A still further object of the invention is to improve the accuracy of reproduction of sound reinforcement systems by reducing acoustic feedback.

BRIEF DESCRIPTION OF THE DRAWINGS

These and other objects and advantages of the invention will become apparent upon reading the following description in conjunction with the drawings, in which.

DESCRIPTION OF THE PREFERRED EMBODIMENT

This invention is concerned with the effects of time delayed back EMF signals generated by magnetic loudspeakers acting as microphones. As a microphone, a loudspeaker generates an output voltage in response to acoustic waves impinging upon its diaphragm. When the acoustic waves result from reflections from room boundaries or from the acoustic output of other loudspeakers spaced at a distance, the back EMF voltages generated are delayed by the time it takes for the acoustic signals to travel between the loudspeakers and to reflect from walls, ceiling and floor. The delayed coupling between the loudspeakers and reflective boundaries becomes a form of acoustic feedback if the signals are coupled back into the power amplifiers. Negative feedback circuits, which are found in most power amplifiers, are so arranged that the time delayed signals generated by the loudspeaker will be introduced back into the amplifier through the negative feedback connection. As a result, the time delayed signals from the loudspeaker are modulated onto the input signal to the amplifier. This reintroduction by the feedback circuit contributes to reinforcing the characteristics of the acoustic coupling and to an increase in false reverberation energy. It has been discovered experimentally that the cross coupling of the invention reduces these acoustic feedback effects.

In larger halls with longer acoustic time delays, the reduction in acoustic feedback produced by this invention results in remarkable improvements in both sound quality and system gain. When applied to stereo reproduction in moderate size rooms, the accuracy of reproduction is increased by the improvements in dynamic contrast, image stability and a new improved center image, all resulting from the reduction in loudspeaker-to-loudspeaker and loudspeaker-to-room interaction.

Figure 1:
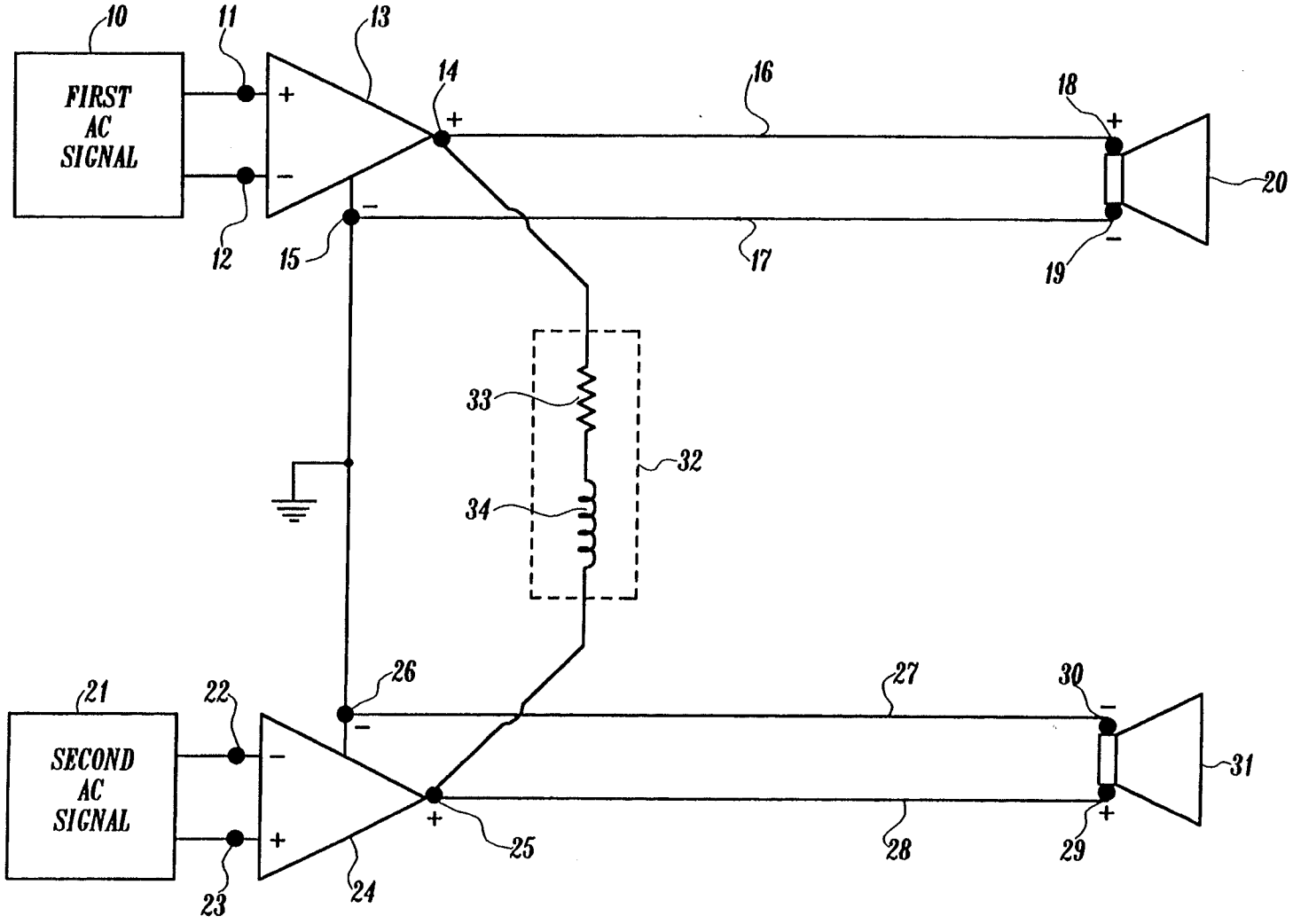
FIG. 1 is a basic form of the invention used with a pair of power amplifiers and a pair of loudspeakers.

Referring to FIG. 1, a first source of AC signal 10 is supplied to the signal input terminals 11 and 12 of a first audio amplifier 13. Audio amplifier 13 has a positive signal output terminal 14 and a negative signal output terminal 15 for supplying signal to a first loudspeaker 20, by means of a pair of connecting wires 16 and 17 that are connected to positive and negative loudspeaker terminals 18 and 19, respectively. In a similar manner, a second audio amplifier 24, with signal input terminals 22 and 23 is connected to a second source of AC signal 21. Amplifier 24 has a positive signal output terminal 25 and a negative signal output terminal 26 which deliver signal to a second loudspeaker 31, via connecting wires 27 and 28 that are connected to positive and negative loudspeaker input terminals 29 and 30, respectively. Audio amplifiers 13 and 24 may be individual units, or as is common in stereo applications, constructed on a common chassis. The inventive coupling circuit 32 (enclosed within a dashed line block) includes a resistor 33 and an inductor 34 that are connected in series between the positive signal terminal 14 of amplifier 13 and the positive signal terminal 25 of amplifier 24. The negative terminals of amplifiers 13 and 14 are connected to a common point indicated as ground.

The coupling circuit 32 (resistor 33 and inductor 34) cross couple the positive signal output terminals of amplifier 13 and amplifier 24. The inductor 34 isolates the two amplifier outputs at frequencies above the audio band to prevent amplifier oscillation and has a value in the range of 200 to 2000 microhenries. When the output signals of amplifier 13 and amplifier 24 are identical, as occurs with a common signal or with the monophonic component of a stereo signal, no current flows in the coupling circuit 32. Coupling circuit current flows from one amplifier to the other only for non common mode signals. The cross coupled signals or currents feed a portion of the output of each amplifier to the output terminal of the other amplifier and to the loudspeakers. The magnitude of the cross coupled signal is a function of the output impedance of each of the amplifiers divided by the value of resistor 33. It has been found experimentally that the signal attenuation of the coupling network 32 should be between 45 dB and 70 dB. For an audio amplifier with typical damping factors of 80 to 300, the value of resistor 33 will range between 20 and 200 ohms. Resistor 33 and inductor 34 may be combined into a single component, i.e., a choke of suitable DC resistance.

Figure 2:
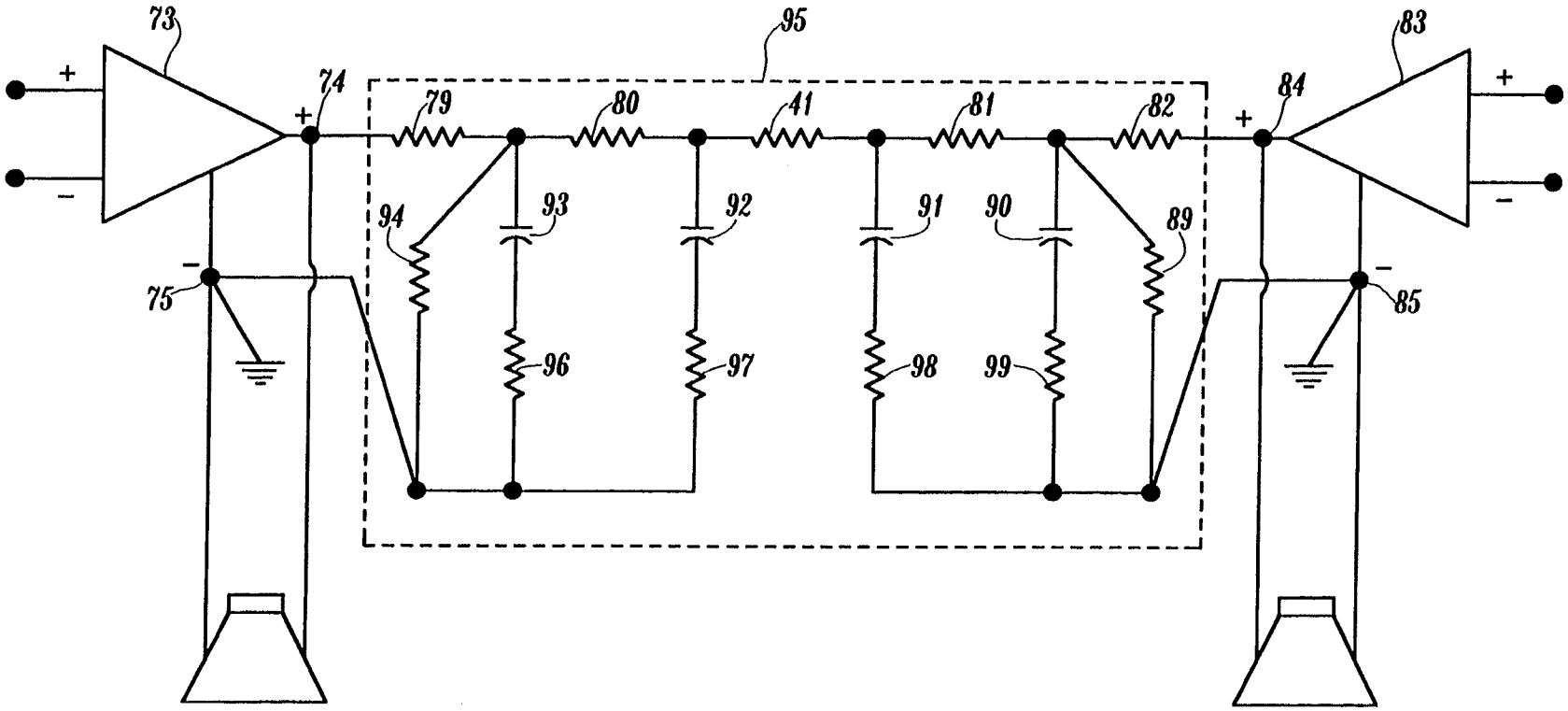
FIG. 2 is a modified form of the low pass intercoupling filter shown in FIG. 1.

FIG. 2 illustrates an alternative cross coupling network or filter 95 (indicated by the dashed line block) to that shown in FIG. 1. Resistors 79, 80, 41 and 82 are connected in series between the positive output terminal 74 of a first audio power amplifier 73, and the positive output terminal 84 of a second audio power amplifier 83. A shunt capacitor 93, in series with a stopper resistor 96, is connected between the negative terminal 75 of amplifier 73 and the junction of resistors 79 and 80. In like manner, a shunt capacitor 92, in series with a stopper resistor 97, is connected between the junction of resistors 80 and 41 and the negative terminal 75 of amplifier 73. The capacitors serve to shunt high frequencies away from the amplifier-to-amplifier connection so as to reduce high frequency amplifier instability. Capacitors 90 and 91, in series with stopper resistors 99 and 98, respectively, are connected in a like manner to the junctions of resistors 81 and 41 and of resistors 81 and 82, for filtering the output of amplifier 83. The stopper resistors 96, 97, 98 and 99 that are connected in series with each of the shunt capacitors are small resistors, i.e. about 0.5 to four ohms in value, and help control ringing of the low pass filter. The total resistance of the five series connected resisters 79, 80, 41, 81 and 82 should be in the range of 20 to 200 ohms, and the capacitors are selected to shunt frequencies in excess of 10–15 KHz. Typical values are 10 to 40 ohms for each of the series connected resisters and 0.1 μF to 0.47 μF for each shunt capacitor. The series resistor 41 is typically on the order of one to five ohms and help to isolate and decouple the two sections of the filter. The shunt resisters 89 and 94 serve to both set the attenuation ratio of the coupling network and to control energy storage in the capacitors. Typical value are 100 ohms to 500 ohms.

Figure 3:
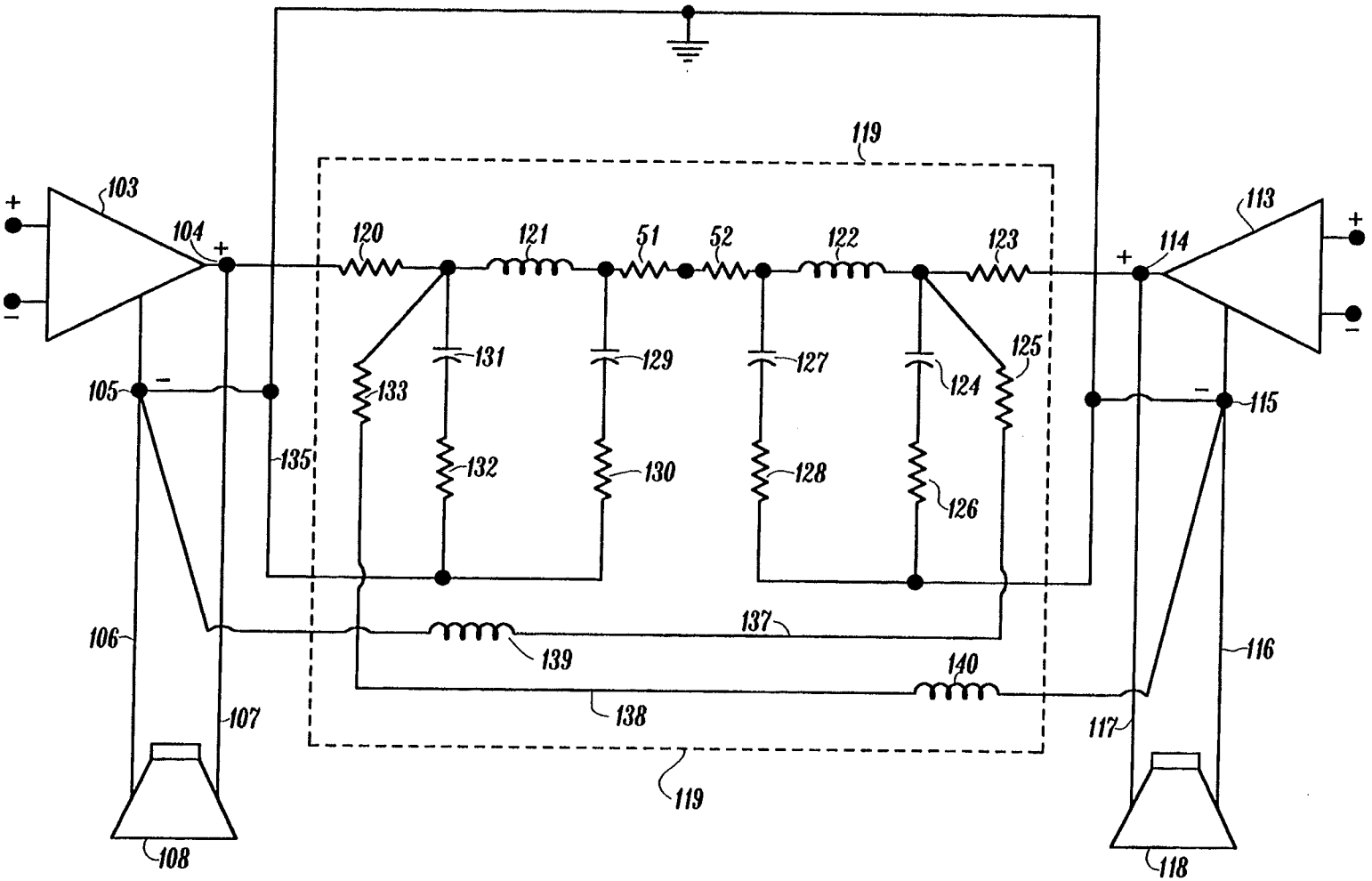
FIG. 3 discloses the preferred form of the low pass filter shown in FIG. 1.

FIG. 3 illustrates the preferred embodiment of the invention which improves its effectiveness with amplifiers employing large amounts of negative feedback. The low pass filter circuit 119 is contained within the dashed line block. Separating the inductance of FIG. 1 into two or more parts improves isolation between the amplifiers by increasing high frequency attenuation. Amplifier 103 is connected to loudspeaker 108 by means of wires 106 and 107. In a similar manner amplifier 113 is connected to loudspeaker 118 by wires 116 and 117. While a single loudspeaker is shown connected to each of the power amplifiers, each loudspeaker can consist of multiple driver arrays as is common in high powered sound reinforcement installations. The amplifiers 103 and 113 are each connected to a monophonic or stereo AC signal source, not shown.

A first filter network section comprises a resistor 120 connected in series with an inductor 121 and a small resistor 51. Resistor 51 is connected to the second section of the filter, consisting of resistor 52 and an inductor 122 in series with a resistor 123. The shunt capacitors 124, 127, 129 and 131 act in combination with the inductors 121 and 122 and with the series resisters 120 and 123 to form a pair of low pass filters in which a fraction of the outputs of each of the amplifiers 103 and 113 are cross coupled within the audio band of frequencies (to about 15 KHz to 20 KHz). Frequencies above this range are substantially attenuated. Again, stopper resistors 126, 128, 130 and 132 are connected in series with each of the shunt capacitors to reduce filter ringing. Shunt resistors 125 and 133 act to damp energy stored in the inductors 121 and 122. As is well known in radio frequency coil design, low capacitance winding techniques should be used in constructing the inductors to reduce high frequency feedthrough. Because of the need for isolation between the amplifiers, all capacitive and inductive coupling must be considered and layouts that maximize isolation between the amplifiers are desirable. In this respect, it should be noted that the grounds for each high frequency shunt half of the filter are kept separate and are returned only to the ground return of the corresponding amplifier which supplies signal to the input for that filter section. Thus wire 135, the return connection for the capacitor shunt elements of the left section of the filter is connected to negative terminal 105 of amplifier 103 and wire 136 is connected to the returns of the capacitive shunt elements of the right section of the filter to negative terminal 115 of amplifier 113. The grounds 105 and 113 are connected together.

An improvement in image separation and delineation, valuable in stereo applications, can be obtained by cross coupling the ground returns of the shunt damping resistors 125 and 133, to the non corresponding amplifier grounds. As shown in FIG. 3, the ground return (wire 137) of damping resistor 125, is returned to the ground terminal 105 of non corresponding amplifier 103 through an inductor 139, and the ground return (wire 138) of damping resistor 133 is returned to ground terminal 115 of non corresponding amplifier 113 through an inductor 140. In some instances, cross coupling the damping resistors can compromise high frequency stability. In these instances, adding inductors 139 and 140 increases the high frequency isolation between the cross coupled damping resistor grounds. Typical values for the network 119 of FIG. 3 are:

Resistors 120 and 123=50 ohms

Resistors 125 and 133=150 ohms
Resistors 51 and 52=2 ohms
Inductors 121, 122, 134 and 140=0.2 mh
Capacitors 124 and 131=0.22 μF
Capacitors 127 and 129=0.47 μF Since it is possible to have substantial current flow in this network the power rating of some of the resistors may need to be between 5 and 50 watts, as determined by their resistance value and the amplifier power that may be applied. While overall improvements in sound reproduction can be obtained using common inductors and resistors in the circuit of FIG. 3, better results are obtained when the parts used are manufactured to be stable with voltage and current variations. This is especially true for the inductors which should preferably not have iron cores and should be mechanically stabilized and impregnated so as to reduce any wire motion that might result from signal induced magnetic forces.

The relatively low cost circuits of this invention, when built into an amplifier assembly or added as an external device, are capable of producing improvements in sound accuracy which are unattainable in any other way, regardless of cost. It is recognized that numerous changes in the described embodiment of the invention will be apparent to those skilled in the art without departing from its true spirit and scope. The invention is to be limited only as defined in the claims.

What is claimed is:

1. A sound reproducing system comprising:

two audio power amplifiers and two loudspeakers, each of said two audio power amplifiers and each of said two loudspeakers having a positive terminal and a negative terminal;

interconnecting leads connecting the positive terminals and the negative terminals of said two audio power amplifiers to the positive terminals and the negative terminals of said two loudspeakers, respectively;

said two loudspeakers, in response to acoustic energy, producing back EMF electrical signals that undesirably interact with said two audio power amplifiers to produce distortion and reverberation; and low pass filter coupling means connected between the positive terminals of said two audio power amplifiers for reducing said distortion and reverberation.

2. The system of claim 1 wherein said low pass filter means includes series resistance means.

3. The system of claim 2 wherein said series resistance means has a value between about 20 and 200 ohms and wherein said low pass filter means attenuates frequencies above about 15 KHz.

4. The system of claim 2 wherein said low pass filter means has two sections, each section having both series elements and shunt reactive elements and wherein each of said shunt reactive elements of each of said sections is further connected in series to a low resistance stopper resistor.

5. The system of claim 4 wherein the low resistance stopper resistors of each section are connected to a corresponding one of said terminals of said two audio power amplifiers.

6. The system of claim 4 further including a shunt resistance element in each of said two filter sections and wherein said shunt resistance element of each of said two filter sections is returned to said negative terminal of the non corresponding one of said two audio power amplifiers.

7. The system of claim 6 further including an inductive reactance in series with said shunt resistance of said each of said two filter sections.

8. A sound reproducing system comprising:

two audio power amplifiers and two loudspeakers, said two audio power amplifiers each having a positive output terminal connected to a positive loudspeaker connecting lead, and a negative output terminal connected to a negative loudspeaker connecting lead, said positive loudspeaker connecting leads and said negative loudspeaker connecting leads being connected to said two loudspeakers, respectively, said two loudspeakers, in response to acoustic energy, producing back EMF electrical signals that undesirably interact with said two audio power amplifiers to produce distortion and reverberation, and coupling means connected between both of said positive output terminals of said two audio power amplifiers, said coupling means operating primarily on frequencies in the audio band and attenuating frequencies above said audio band.

9. The system of claim 8 wherein said coupling means attenuates frequencies between DC and approximately 10 KHz in the range of 40 to 70 dB, and increases attenuation with increasing frequency above about 10 KHz.

* * * * *